US005176816A

United States Patent [19]

Lankton et al.

[11] Patent Number: 5,176,816

[45] Date of Patent: Jan. 5, 1993

[54] PROCESS TO PRODUCE A HYDROGENATED DISTILLABLE HYDROCARBONACEOUS PRODUCT

[75] Inventors: Steven P. Lankton, Wheeling; Robert B. James, Jr., Northbrook, both of Ill.

[73] Assignee: UOP, Des Plaines, Ill.

[21] Appl. No.: 862,146

[22] Filed: Apr. 2, 1992

[51] Int. Cl.[5] ..... C10G 65/04

[52] U.S. Cl. ..... 208/85; 208/89; 208/107; 208/144; 208/57; 208/67

[58] Field of Search ..... 208/85, 89, 107, 144

[56] References Cited

U.S. PATENT DOCUMENTS 4,882,037 8/1988 Kalnes ..... 208/89

4,923,590 5/1990 Kalnes ..... 208/85

*Primary Examiner*—Helane Myers

*Attorney, Agent, or Firm*—Thomas K. McBride; John G. Tolomei; John G. Cutts, Jr.

[57] ABSTRACT

An integrated process for the production of a hydrogenated distillable hydrocarbonaceous product from a temperature-sensitive hydrocarbonaceous stream containing a non-distillable component by the utilization of a hot hydrogen flash zone and a secondary separation zone to achieve a high yield of hydrogenated distillable hydrocarbonaceous product.

13 Claims, 1 Drawing Sheet

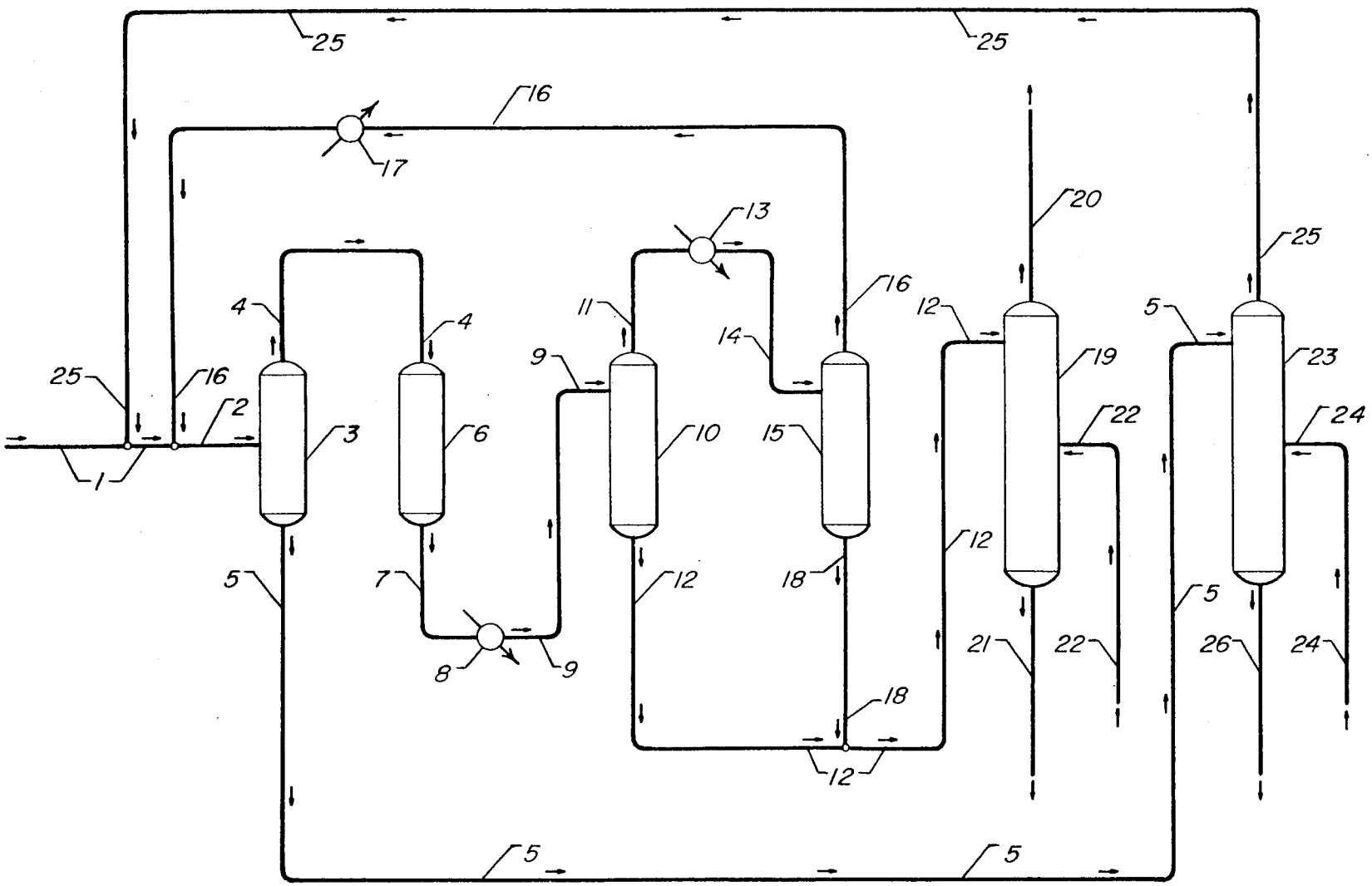
1
2
3
4
5
6
7
8
9
10
11
12
13
14
15
16
17
18
19
20
21
22
23
24
25
26

PROCESS TO PRODUCE A HYDROGENATED DISTILLABLE HYDROCARBONACEOUS PRODUCT

FIELD OF THE INVENTION

The field of art to which this invention pertains is the production of a hydrogenated distillable hydrocarbonaceous product from a temperature-sensitive hydrocarbonaceous stream containing a non-distillable component. More specifically, the invention relates to an integrated process for treating a temperature-sensitive hydrocarbonaceous stream containing a non-distillable component to produce a hydrogenated distillable hydrocarbonaceous product and a heavy product by the utilization of a hot hydrogen flash zone and a secondary separation zone to achieve a high yield of hydrogenated distillable hydrocarbonaceous product.

BACKGROUND OF THE INVENTION

In U.S. Pat. No. 4,923,590 (Kalnes et al), a process is disclosed for the production of a hydrogenated distillable hydrocarbonaceous product wherein a hot hydrogen flash separator is used to produce the feed to a hydrogenation reaction zone in order to produce the desired product stream.

BRIEF SUMMARY OF THE INVENTION

The present invention provides a process having higher distillable product yields for the production of a hydrogenated distillable hydrocarbonaceous product from a temperature-sensitive hydrocarbonaceous stream containing a non-distillable component by means of contacting the hydrocarbonaceous feed stream with a hot hydrogen-rich gaseous stream to increase the temperature of the feed stream with minimal thermal degradation and to vaporize at least a portion of the distillable hydrocarbonaceous compounds thereby producing a distillable hydrocarbonaceous product which is immediately hydrogenated in an integrated hydrogenation zone without intermediate separation. In order to achieve high levels of recovered desirable product, the bottom residual stream from the hot hydrogen flash zone is introduced into a secondary separation zone which recovers additional distillable hydrocarbonaceous material which is recycled to the integrated hydrogenation zone. Important elements of the improved process are the enhanced distillable product yields and the minimization of utility costs due to the integration of the hot flash zone, the hydrogenation zone and the secondary separation zone. The present invention enjoys the advantage of having an improved yield of the desired hydrogenated distillable hydrocarbonaceous product.

One embodiment of the invention may be characterized as a process for treating a temperature-sensitive hydrocarbonaceous stream containing a non-distillable component to produce a hydrogenated distillable hydrocarbonaceous product and a heavy product comprising the non-distillable component while minimizing thermal degradation of the hydrocarbonaceous stream which process comprises the steps of: (a) contacting the hydrocarbonaceous stream with a first hydrogen-rich gaseous stream having a temperature greater than the hydrocarbonaceous stream in a flash zone at flash conditions thereby increasing the temperature of the hydrocarbonaceous stream with minimal thermal degradation and vaporizing at least a portion thereof to produce a hydrocarbonaceous vapor stream comprising hydrogen and a heavy stream comprising the non-distillable component and entrained distillable hydrocarbonaceous compounds; (b) contacting the hydrocarbonaceous vapor stream comprising hydrogen recovered from step (a) without intermediate separation with a hydrogenation catalyst in a hydrogenation reaction zone at hydrogenation conditions to increase the hydrogen content of the hydrocarbonaceous compounds contained in the hydrocarbonaceous vapor stream; (c) condensing at least a portion of the resulting effluent from the hydrogenation reaction zone to produce a second hydrogen-rich gaseous stream and a liquid stream comprising hydrogenated distillable hydrocarbonaceous compounds; (d) separating the heavy stream comprising the non-distillable component and entrained distillable hydrocarbonaceous compounds in a separation zone to produce a heavy product stream comprising the non-distillable component and a stream comprising at least a portion of the entrained distillable hydrocarbonaceous compounds; (e) recycling at least a portion of the entrained distillable hydrocarbonaceous compounds to the hydrogenation reaction zone; and (f) recovering the liquid stream comprising hydrogenated distillable hydrocarbonaceous compounds produced in step (c).

Other embodiments of the present invention encompass further details such as preferred feedstocks, hydrogenation catalysts, preferred separation zones for the treatment of the residual stream to recover additional distillable hydrocarbonaceous compounds and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

There is a steadily increasing demand for technology which is capable of treating a temperature-sensitive hydrocarbonaceous stream containing a non-distillable component to produce a hydrogenated distillable hydrocarbonaceous product and a heavy non-distillable product having minimal quantities of distillable compounds while minimizing thermal degradation of the hydrocarbonaceous feed stream. Such treatment has always been in demand for the preparation and production of various hydrocarbonaceous products, but with the increased environmental emphasis for the treatment and recycle of waste hydrocarbonaceous products, there is an increased need for improved processes to separate heavy non-distillable components from a distillable hydrocarbonaceous product with high recoveries which may then be hydrogenated. For example, during the disposal or recycle of potentially environmentally harmful hydrocarbonaceous waste streams, an important step in the total solution to the problem is the pretreatment or conditioning of a hydrocarbonaceous stream which facilitates the ultimate resolution to provide product streams which may subsequently be handled in an environmentally acceptable manner. Therefore, those skilled in the art have sought to find feasible techniques to remove heavy non-distillable components from a temperature-sensitive hydrocarbonaceous stream to provide a distillable hydrocarbonaceous product which may then be hydrogenated. In accordance with the present invention, even greater recoveries of distillable components are now possible.

The present invention provides an improved integrated process for the removal of heavy non-distillable components from a temperature-sensitive hydrocarbonaceous stream and the subsequent hydrogenation of the distillable hydrocarbonaceous stream. In addition, since the thermal degradation of the feedstock is minimized, the overall yield of the hydrogenated distillable hydrocarbonaceous product stream is thereby maximized resulting in more favorable and economical operation. A wide variety of temperature-sensitive hydrocarbonaceous streams are to be candidates for feed streams in accordance with the process of the present invention. Examples of hydrocarbonaceous streams which are suitable for treatment by the process of the present invention are dielectric fluids, hydraulic fluids, heat transfer fluids, used lubricating oil, used cutting oils, used solvents, still bottoms from solvent recycle operations, coal tars, atmospheric residuum, oils contaminated with polychlorinated biphenyls (PCB), halogenated wastes and other hydrocarbonaceous industrial waste. Many of these hydrocarbonaceous streams may contain non-distillable components which include, for example, organometallic compounds, inorganic metallic compounds, finely divided particulate matter and non-distillable hydrocarbonaceous compounds. The present invention is particularly advantageous when the non-distillable components comprise sub-micron particulate matter and the conventional techniques of filtration or centrifugation tend to be highly ineffective.

The presence of a non-distillable component including finely divided particulate matter in a hydrocarbonaceous feed to a hydrogenation zone greatly increases the difficulty of the hydrogenation. A non-distillable component tends 1) to foul the hot heat exchange surfaces which are used to heat the feed to hydrogenation conditions, 2) to form coke or in some other manner deactivate the hydrogenation catalyst thereby shortening its active life and 3) to otherwise hinder a smooth and facile hydrogenation operation. Particulate matter in a feed stream tends to deposit within the hydrogenation zone and to plug a fixed hydrogenation catalyst bed thereby abbreviating the time on stream.

Once the temperature-sensitive hydrocarbonaceous feed stream is separated into a distillable hydrocarbonaceous stream and a heavy non-distillable product, the resulting distillable hydrocarbonaceous stream is introduced into a hydrogenation zone. If the feed stream contains metallic compounds which contain metals such as zinc, copper, iron, barium, phosphorus, magnesium, aluminum, lead, mercury, cadmium, cobalt, arsenic, vanadium, chromium, and nickel, these compounds will be isolated in the relatively small volume of recovered non-distillable product which may then be treated for metals recovery or otherwise disposed of as desired. In the event that the feed stream contains distillable hydrocarbonaceous compounds which include sulfur, oxygen, nitrogen, metal or halogen components, the resulting recovered distillable hydrocarbonaceous stream is hydrogenated to remove or convert such components as desired. In a preferred embodiment of the present invention, the hydrogenation of the resulting distillable hydrocarbonaceous stream is preferably conducted immediately without intermediate separation or condensation. The advantages of the integrated process of the present invention will be readily apparent to those skilled in the art and include the economy of greatly reduced utility costs.

In accordance with the subject invention, a temperature-sensitive hydrocarbonaceous stream containing a non-distillable component is contacted with a hot hydrogen-rich gaseous stream having a temperature greater than the hydrocarbonaceous stream in a flash zone at flash conditions thereby increasing the temperature of the hydrocarbonaceous stream and vaporizing at least a portion thereof to provide a hydrocarbonaceous vapor stream comprising hydrogen and a heavy non-distillable product. The hot hydrogen-rich gaseous stream preferably comprises more than about 70 mole % hydrogen and more preferably more than about 90 mole % hydrogen. The hot hydrogen-rich gaseous stream is multi-functional and serves as 1) a heat source used to directly heat the hydrocarbonaceous feed stream to preclude the coke formation that could otherwise occur when using an indirect heating apparatus such as a heater or heat-exchanger, 2) a diluent to reduce the partial pressure of the hydrocarbonaceous compounds during vaporization in the flash zone, 3) a possible reactant to minimize the formation of hydrocarbonaceous polymers at elevated temperatures, 4) a stripping medium and 5) at least a portion of the hydrogen required in the hydrogenation reaction zone. In accordance with the subject invention, the temperature-sensitive hydrocarbonaceous feed stream is preferably maintained at a temperature less than about 482° F. (250° C.) before being introduced into the flash zone in order to prevent or minimize the thermal degradation of the feed stream. Depending upon the characteristics and composition of the hydrocarbonaceous feed stream, the hot hydrogen-rich gaseous stream is introduced into the flash zone at a temperature greater than the hydrocarbonaceous feed stream and preferably at a temperature from about 200° F. (93° C.) to about 1200° F. (649° C.).

During the contacting, the flash zone is preferably maintained at flash conditions which include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 30,000 SCFB (5056 normal $m/m^3$) based on the temperature-sensitive hydrocarbonaceous feed stream and an average residence time of the hydrogen-containing, hydrocarbonaceous vapor stream in the flash zone from about 0.1 seconds to about 50 seconds. A more preferred average residence time of the hydrogen-containing, hydrocarbonaceous vapor stream in the flash zone is from about 1 second to about 10 seconds.

The resulting heavy non-distillable portion of the feed stream is removed from the bottom of the flash zone as required to yield a heavy non-distillable stream which may contain entrained quantities of distillable components. The heavy non-distillable stream may contain a distillable component of up to about 50 wt. %, and such an amount of distillable component has a heavy impact upon the economics of the overall process. In accordance with the process of the present invention, the resulting heavy non-distillable stream from the bottom of the flash zone is separated in a separation zone to produce a heavy product stream comprising non-distillable components and a stream comprising at least a portion of the entrained distillable hydrocarbonaceous compounds. Although this separation step may utilize any known means for separation, it is preferable that a procedure be used in order to minimize the degradation of the non-distillable component which could possibly complicate the continuous operation of the process. Although fractionation could conceivably be used, it is preferred to utilize a separation procedure such as vacuum flashing or steam stripping. The above-mentioned separation techniques may however be used in the present invention depending upon the individual circumstances and it is contemplated that one or more separation steps may be utilized either separately or in series. This secondary separation zone which is utilized in the process of the present invention to achieve a high yield of hydrogenated distillable hydrocarbonaceous product may be conducted utilizing operating conditions which will become apparent to those skilled in the art. The resulting recovered entrained distillable hydrocarbonaceous compounds are preferably recycled to a hydrogenation reaction zone. In the case where the entrained distillable hydrocarbonaceous compounds are concomitantly recovered with admixed steam and/or water, the hydrocarbonaceous compounds are preferably separated before they are fed to the hydrogenation zone. In one embodiment of the present invention, the recovered distillable hydrocarbonaceous compounds are introduced into the hot hydrogen flash separation zone and in another embodiment of the present invention, the recovered entrained distillable hydrocarbonaceous compounds are introduced directly into a hydrogenation reaction zone.

The resulting hydrogen-containing, hydrocarbonaceous vapor stream is removed from the flash zone and is introduced into a catalytic hydrogenation zone containing hydrogenation catalyst and maintained at hydrogenation conditions. The resulting hydrogen-containing hydrocarbonaceous vapor stream recovered from the flash zone is directly introduced into the hydrogenation reaction zone without intermediate separation thereof. The catalytic hydrogenation zone may contain a fixed, ebullated or fluidized catalyst bed. This reaction zone is preferably maintained under an imposed pressure from about atmospheric (0 kPa gauge) to about 2000 psig (13790 kPa gauge) and more preferably under a pressure from about 100 psig (689.5 kPa gauge) to about 1800 psig (12411 kPa gauge). Suitably, such reaction is conducted with a maximum catalyst bed temperature in the range of about 122° F. (50° C.) to about 850° F. (454° C.) selected to perform the desired hydrogenation conversion to reduce or eliminate the undesirable characteristics or components of the hydrocarbonaceous vapor stream. In accordance with the present invention, it is contemplated that the desired hydrogenation conversion includes, for example, dehalogenation, desulfurization, denitrification, olefin saturation, oxygenate conversion and hydrocracking. Further preferred operating conditions include liquid hourly space velocities in the range from about 0.05 $hr^{-1}$ to about 20 $hr^{-1}$ and hydrogen circulation rates from about 200 standard cubic feet per barrel (SCFB) (33.71 normal $m^3/m^3$) to about 50,000 SCFB (8427 normal $m^3/m^3$), preferably from about 300 SCFB (50.6 normal $m^3/m^3$) to about 40,000 SCFB (6740 normal $m^3/m^3$).

In the event that the temperature of the hydrogen-containing, hydrocarbonaceous stream which is removed from the flash zone is not deemed to be exactly the temperature selected to operate the catalytic hydrogenation zone, it is contemplated that the temperature of the hydrogen-containing, hydrocarbonaceous stream may be adjusted either upward or downward in order to achieve the desired temperature in the catalytic hydrogenation zone. Such a temperature adjustment may be accomplished, for example, by the addition of either cold or hot hydrogen.

The preferred catalytic composite disposed within the hereinabove described hydrogenation zone can be characterized as containing a metallic component having hydrogenation activity, which component is combined with a suitable refractory inorganic oxide carrier material of either synthetic or natural origin. The precise composition and method of manufacturing the carrier material is not considered essential to the present invention. Preferred carrier materials are alumina, silica and mixtures thereof. Suitable metallic components having hydrogenation activity are those selected from the group comprising the metals of Groups VI-B and VIII of the Periodic Table, as set forth in the Periodic Table of the Elements, E. H. Sargent and Company, 1964. Thus, the catalytic composites may comprise one or more metallic components from the group of molybdenum, tungsten, chromium, iron, cobalt, nickel, platinum, palladium, iridium, osmium, rhodium, ruthenium, and mixtures thereof. The concentration of the catalytically active metallic component, or components, is primarily dependent upon a particular metal as well as the physical and/or chemical characteristics of the particular hydrocarbon feedstock. For example, the metallic components of Group VI-B are generally present in an amount within the range of from about 1 to about 20 weight percent, the iron-group metals in an amount within the range of about 0.2 to about 10 weight percent, whereas the noble metals of Group VIII are preferably present in an amount within the range of from about 0.1 to about 5 weight percent, all of which are calculated as if these components existed within the catalytic composite in the elemental state. In addition, any catalyst employed commercially for hydrogenating middle distillate hydrocarbonaceous compounds to remove nitrogen and sulfur may function effectively in the hydrogenation zone of the present invention. It is further contemplated that hydrogenation catalytic composites may comprise one or more of the following components: cesium, francium, lithium, potassium, rubidium, sodium, copper, gold, silver, cadmium, mercury and zinc.

The hydrocarbonaceous effluent from the hydrogenation zone is preferably contacted with an aqueous scrubbing solution and the admixture is admitted to a separation zone in order to separate a spent aqueous stream, a hydrogenated hydrocarbonaceous liquid phase and a hydrogen-rich gaseous phase. The contact of the hydrocarbonaceous effluent from the hydrogenation zone with the aqueous scrubbing solution may be performed in any convenient manner and is preferably conducted by co-current, in-line mixing which may be promoted by inherent turbulence, mixing orifices or any other suitable mixing means. The aqueous scrubbing solution is preferably introduced in an amount from about 1 to about 100 volume percent based on the hydrocarbonaceous effluent from the hydrogenation zone. The aqueous scrubbing solution is selected depending on the characteristics of the hydrocarbonaceous vapor stream introduced into the hydrogenation zone. For example, if the hydrocarbonaceous vapor stream to the hydrogenation zone comprises halogenated compounds, the aqueous scrubbing solution preferably contains a basic compound such as calcium hydroxide, potassium hydroxide or sodium hydroxide in order to neutralize the acid such as hydrogen chloride, hydrogen bromide and hydrogen fluoride, for example, which is formed during the hydrogenation of the halogen compounds. In the event that the hydrocarbonaceous vapor stream contains only sulfur and nitrogen compounds, water may be a suitable aqueous scrubbing solution to dissolve the resulting hydrogen sulfide and ammonia. The resulting hydrogenated hydrocarbonaceous liquid phase is recovered and the hydrogen-rich gaseous phase may be recylcled to the hydrogenation zone if desired.

The resulting hydrogenated hydrocarbonaceous liquid phase is preferably recovered from the hydrogen-rich gaseous phase in a separation zone which is maintained at essentially the same pressure as the hydrogenation reaction zone and as a consequence contains dissolved hydrogen and low molecular weight normally gaseous hydrocarbons if present. In accordance with the present invention, it is preferred that the hydrogenated hydrocarbonaceous liquid phase comprising the hereinabove-mentioned gases be stabilized in a convenient manner, such as, for example, by stripping or flashing to remove the normally gaseous components to provide a stable hydrogenated distillable hydrocarbonaceous product.

In the drawing, the process of the present invention is illustrated by means of a simplifed flow diagram in which such details as pumps, instrumentation, heat-exchange and heat-recovery circuits, compressors and similar hardware have been deleted as being non-essential to an understanding of the techniques involved. The use of such miscellaneous appurtenances are well within the purview of one skilled in the art.

With reference now to the drawing, a liquid hydrocarbonaceous feed stream having a non-distillable component is introduced into the process via conduit 1, joined by a recycle stream containing distillable hydrocarbonaceous components provided via conduit 25 and the resulting admixture is contacted with a hot gaseous hydrogen-rich recycle stream which is provided via conduit 16 and hereinafter described. The liquid hydrocarbonaceous feed stream, the distillable hydrocarbonaceous recycle stream and the hydrogen-rich recycle stream are then transported via conduit 2 to be intimately contacted in hot hydrogen flash separator 3. A hydrocarbonaceous vapor stream comprising hydrogen is removed from hot hydrogen flash separator 3 via conduit 4 and introduced into hydrogenation reaction zone 6 without intermediate separation thereof. A heavy non-distillable stream is removed from the bottom of hot hydrogen flash separator 3 via conduit 5 and introduced into steam stripping zone 23. A stream containing distillable hydrocarbonaceous components is removed from steam stripping zone 23 via conduit 25 and recycled as described hereinabove. A heavy non-distillable stream is removed from the bottom of steam stripping zone 23 via conduit 26 and recovered. The resulting hydrogenated hydrocarbonaceous stream is removed from hydrogenation reaction zone 6 via conduit 7, cooled in heat exchanger 8 and transported from said heat exchanger via conduit 9 into hot high pressure vapor/liquid separator 10. A hydrogen-rich gaseous stream is removed from hot high pressure vapor/liquid separator 10 via conduit 11, cooled in heat exchanger 13 and introduced via conduit 14 into cold high pressure vapor/liquid separator 15. A hydrogen-rich gaseous stream is removed from cold high pressure vapor/liquid separator 15 via conduit 16, heated to a suitable temperature in heat exchanger 17, transported via conduit 16 and utilized to contact the waste oil feed stream and recycle stream as hereinabove described. Since hydrogen is lost in the process by means of a portion of the hydrogen being dissolved in the exiting liquid hydrocarbon and hydrogen being consumed during the hydrogenation reaction, it is necessary to supplement the hydrogen-rich gaseous stream with makeup hydrogen from some suitable external source, for example, a catalytic reforming unit or a hydrogen plant. Makeup hydrogen may be introduced into the system at any convenient and suitable point not shown in the drawing. A liquid hydrogenated hydrocarbonaceous stream comprising hydrogen in solution is removed from hot high pressure vapor liquid separator 10 via conduit 12 and another liquid hydrogenated hydrocarbonaceous stream comprising hydrogen in solution is removed from cold high pressure vapor/liquid separator 15 via conduit 18 and these two streams are joined and transported via conduit 12 and introduced into product stripper 19. A gaseous stream comprising hydrogen and any normally gaseous hydrocarbons present is removed from product stripper 19 via conduit 20 and recovered. A normally liquid distillable hydrogenated hydrocarbonaceous product stream is removed from product stripper 19 via conduit 21 and recovered. Steam is introduced via conduit 22 into product stripper 19 and steam is also introduced via conduit 24 into steam stripping zone 23.

The process of the present invention is further demonstrated by the following illustrative embodiment. This illustrative embodiment is however not presented to unduly limit the process of this invention, but to further illustrate the advantages of the hereinabove-described embodiments. The following data were not completely obtained by the actual performance of the present invention, but are considered prospective and reasonably illustrative of the expected performance of the invention and are derived from engineering calculations.

ILLUSTRATIVE EMBODIMENT

A feedstock having the characteristics presented in Table 1 is charged at a rate of 100 mass units per hour to a hot hydrogen flash separation zone. In addition, a liquid recycle stream having the characteristics presented in Table 2 in an amount of 10 mass units per hour and a hydrogen-rich gaseous recycle stream containing hydrogen in an amount of 200 mass units per hour (10,400 MM SCFH) is also introduced into the hot hydrogen flash separation zone. The feedstock and the liquid recycle stream are intimately contacted in the hot flash separation zone with the hot hydrogen-rich gaseous recycle stream having a temperature upon introduction into the hot hydrogen flash separation zone of 960° F. (515° C.). In addition, the hot hydrogen flash separation zone is operated at conditions which includes a temperature of 700° F. (370° C.), a pressure of 875 psig (6133 kPa), a hydrogen circulation rate of 23,600 SCFB (3979 normal $m^3/m^3$) and an average residence time of the vapor stream of 5 seconds. A hydrocarbonaceous vapor stream comprising hydrogen is recovered from the hot hydrogen flash separation zone, and directly introduced without separation into a hydrogenation reaction zone containing a hydrogenation catalyst comprising alumina, cobalt and molybdenum. The hydrogenation reaction is conducted with a catalyst peak temperature of 725° F. (385° C.), a pressure of 860 psig (6030 kPa), a liquid hourly space velocity of 2 based on total hydrocarbon feed to the hydrogenation reaction zone and a hydrogen circulation rate of 30,800 SCFB (5200 normal $m^3/m^3$). The hydrogenated effluent from the hydrogenation reaction zone is cooled to about 425° F. (218° C.) and sent to a hot vapor-liquid separator wherein a gaseous stream containing hydrogen and hydrocarbonaceous compounds is separated from a liquid hydrocarbonaceous stream. The resulting gaseous stream containing hydrogen and hydrocarbonaceous compounds is then cooled to about 115° F. (46° C.) and sent to a cold vapor-liquid separator wherein a gaseous hydrogen-rich stream is separated from normally liquid hydrocarbonaceous components. The resulting gaseous hydrogen-rich stream is heated and then recycled to the hot hydrogen flash separation zone together with a fresh supply of hydrogen in an amount sufficient to maintain the hydrogenation reaction zone pressure. The liquid hydrocarbonaceous stream from the hot vapor-liquid separator and the normally liquid hydrocarbonaceous components from the cold vapor-liquid separator are introduced into a product stripper which is maintained at a pressure of 90 psig (722 kPa). A net overhead gaseous stream in an amount of 1.7 mass units per hour and having the characteristics presented in Table 3 is recovered from the hereinabove mentioned product stripper.

TABLE 1

| FEEDSTOCK ANALYSIS | | |
|---|---|---|
| Specific Gravity at 60° F. (15° C.) | 0.90 | |
| TBP Distillation Boiling Range | °F. | °C. |
| IBP | 218 | 103 |
| 10% | 476 | 246 |
| 20% | 690 | 365 |
| 30% | 724 | 385 |
| 40% | 750 | 399 |
| 50% | 775 | 413 |
| 60% | 800 | 426 |
| 70% | 831 | 444 |
| 80% | 880 | 471 |
| 90% | 955 | 513 |
| 100% | 1242 | 671 |

TABLE 2

| LIQUID RECYCLE ANALYSIS | | |
|---|---|---|
| Specific Gravity at 60° F. (15° C.) | 0.9 | |
| TBP Distillation Boiling Range | °F. | °C. |
| IBP | 200 | 93 |
| 10% | 700 | 371 |
| 20% | 729 | 386 |
| 50% | 787 | 419 |
| 70% | 823 | 440 |
| 90% | 895 | 479 |
| 100% | 1004 | 540 |

TABLE 3

| ANALYSIS OF PRODUCT STRIPPER NET OVERHEAD GAS STREAM | |
|---|---|
| Component | Mole Percent |
| Hydrogen | 29 |
| $C_1$ | 10 |
| $C_2$ | 18 |
| $C_3$ | 16 |
| $C_4$ | 26 |
| $C_5^+$ | 1 |

A hydrogenated hydrocarbonaceous liquid stream in an amount of 76.6 mass units per hour having the characteristics presented in Table 4 is removed from the product stripper.

TABLE 4

| ANALYSIS OF HYDROGENATED HYDROCARBONACEOUS LIQUID STREAM | | |
|---|---|---|
| Specific Gravity at 60° F. (15° C.) | 0.87 | |
| Sulfur, Weight Percent | 0.05 | |
| TBP Distillation Boiling Range | °F. | °C. |
| 10% | 350 | 177 |
| 50% | 750 | 399 |
| 90% | 900 | 482 |

A non-distillable liquid stream containing entrained distillable hydrocarbonaceous compounds is recovered from the bottom of the hot hydrogen flash separation zone in an amount of 26 mass units per hour and introduced into a steam stripping column in order to recover entrained distillable hydrocarbonaceous compounds in an amount of 10 mass units per hour and having the characteristics presented in Table 5.

TABLE 5

| ANALYSIS OF ENTRAINED DISTILLABLE HYDROCARBONACEOUS COMPOUNDS | | |
|---|---|---|
| Specific Gravity at 60° F. (15° C.) | 0.90 | |
| TBP Distillation Boiling Range | °F. | °C. |
| 10% | 700 | 371 |
| 50% | 787 | 419 |
| 90% | 895 | 479 |

A non-distillable liquid stream is recovered from the bottom of the steam stripping column in an amount of 16 mass units per hour and having the characteristics presented in Table 6. Entrained water contained in the feedstock in an amount of 5.7 mass units per hour is also recovered.

TABLE 6

| ANALYSIS OF NON-DISTILLABLE STREAM | |
|---|---|
| Specific Gravity at 60° F. (15° C.) | 0.93 |

The foregoing description, drawing and illustrative embodiment clearly illustrate the advantages encompassed by the process of the present invention and the benefits to be afforded with the use thereof.

What is claimed:

1. A process for treating a temperature-sensitive hydrocarbonaceous stream containing a non-distillable component to produce a hydrogenated distillable hydrocarbonaceous product and a heavy product comprising said non-distillable component while minimizing thermal degradation of said hydrocarbonaceous stream which process comprises the steps of:

(a) contacting said hydrocarbonaceous stream with a first hydrogen-rich gaseous stream having a temperature greater than said hydrocarbonaceous stream in a flash zone at flash conditions thereby increasing the temperature of said hydrocarbonaceous stream with minimal thermal degradation and vaporizing at least a portion thereof to produce a hydrocarbonaceous vapor stream comprising hydrogen and a heavy stream comprising said non-distillable component and entrained distillable hydrocarbonaceous compounds;

(b) contacting said hydrocarbonaceous vapor stream comprising hydrogen recovered from step (a) without intermediate separation with a hydrogenation catalyst in a hydrogenation reaction zone at hydrogenation conditions to increase the hydrogen content of the hydrocarbonaceous compounds contained in said hydrocarbonaceous vapor stream;

(c) condensing at least a portion of the resulting effluent from said hydrogenation reaction zone to produce a second hydrogen-rich gaseous stream and a liquid stream comprising hydrogenated distillable hydrocarbonaceous compounds;

(d) separating said heavy stream comprising said non-distillable component and entrained distillable hydrocarbonaceous compounds in a separation zone to produce a heavy product stream comprising said non-distillable component and a stream comprising at least a portion of said entrained distillable hydrocarbonaceous compounds;

(e) recycling at least a portion of said entrained distillable hydrocarbonaceous compounds to said hydrogenation reaction zone: and (f) recovering said liquid stream comprising hydrogenated distillable hydrocarbonaceous compounds produced in step (c).

2. The process of claim 1 wherein at least a portion of said second hydrogen-rich gaseous stream is recycled to said hydrogenation reaction zone.

3. The process of claim 1 wherein said separation zone in step (d) is a steam stripping zone.

4. The process of claim 1 wherein said separation zone in step (d) is a vacuum flashing zone.

5. The process of claim 1 wherein said entrained distillable hydrocarbonaceous compounds are recycled to said hydrogenation reaction zone via said flash zone.

6. The process of claim 1 wherein said temperature-sensitive hydrocarbonaceous stream comprises a component consisting essentially of dielectric fluids, hydraulic fluids, heat transfer fluids, used lubricating oil, used cutting oils, used solvents, still bottoms from solvent recovery operations, coal tars, atmospheric residuum, oils contaminated with polychlorinated biphenyls, halogenated wastes and mixtures thereof.

7. The process of claim 1 wherein said non-distillable component comprises a component consisting essentially of organometallic compounds, inorganic metallic compounds, finely divided particulate matter, non-distillable hydrocarbonaceous compounds and admixtures thereof.

8. The process of claim 1 wherein said temperature-sensitive hydrocarbonaceous stream is introduced into said flash zone at a temperature less than about 482° F. (250° C.).

9. The process of claim 1 wherein the temperature of said first hydrogen-rich gaseous stream is from about 200° F. (93° C.) to about 1200° F. (649° C.).

10. The process of claim 1 wherein said flash conditions include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 30,000 SCFB (5056 normal $m^3/m^3$) based on said temperature-sensitive hydrocarbonaceous vapor stream, and an average residence time of said hydrocarbonaceous vapor stream comprising hydrogen in said flash zone from about 0.1 seconds to about 50 seconds.

11. The process of claim 1 wherein said hydrogenation reaction zone is operated at conditions which include a pressure from about atmospheric (0 kPa gauge) to about 2000 psig (13790 kPa gauge), a maximum catalyst temperature from about 122° F. (50° C.) to about 850° F. (454° C.) and a hydrogen circulation rate from about 200 SCFB (33.7 normal $m^3/m^3$) to about 50,000 SCFB (8427 normal std $m^3/m^3$).

12. The process of claim 1 wherein said hydrogenation catalyst comprises a refractory inorganic oxide and at least one metallic compound having hydrogenation activity.

13. The process of claim 12 wherein said metallic compound is selected from the metals of Group VIB and VIII of the Periodic Table.

* * * * *